US008651004B2

(12) United States Patent
Liu et al.

(10) Patent No.: US 8,651,004 B2
(45) Date of Patent: Feb. 18, 2014

(54) CHIP CARTRIDGE FOR SHEET PUNCH

(75) Inventors: Rong Liu, Vernon Hills, IL (US); Christopher H. Cunningham, Mundelein, IL (US); Jason B. Magid, Wheeling, IL (US)

(73) Assignee: ACCO Brands USA LLC, Lake Zurich, IL (US)

( * ) Notice: Subject to any disclaimer, the term of this patent is extended or adjusted under 35 U.S.C. 154(b) by 958 days.

(21) Appl. No.: 11/962,628

(22) Filed: Dec. 21, 2007

(65) Prior Publication Data

US 2009/0158908 A1 Jun. 25, 2009

(51) Int. Cl.
*B26F 1/14* (2006.01)

(52) U.S. Cl.
USPC ..... 83/684; 83/687; 83/698.91; 83/167

(58) Field of Classification Search
USPC ..... 83/687, 167, 599, 691, 698.91, 684; 312/190
See application file for complete search history.

(56) References Cited

U.S. PATENT DOCUMENTS

| | | | | | |
|---|---|---|---|---|---|
| 1,692,764 | A | * | 11/1928 | Salt | 83/167 |
| 2,244,660 | A | | 6/1941 | Carpenter | |
| 2,433,142 | A | | 12/1947 | Moen | |
| 2,481,883 | A | | 9/1949 | Semler | |
| 2,558,567 | A | * | 6/1951 | Kaeser | 83/167 |
| 2,717,643 | A | | 9/1955 | Marano | |
| 2,962,178 | A | * | 11/1960 | Exline | 414/416.08 |
| 3,372,717 | A | | 3/1968 | Fisher | |
| 3,648,555 | A | | 3/1972 | Schraud et al. | |
| 3,808,933 | A | | 5/1974 | Buan | |
| 3,906,633 | A | | 9/1975 | Inoue | |
| 3,938,690 | A | | 2/1976 | Butler | |
| 4,166,404 | A | | 9/1979 | Almog | |
| 4,404,881 | A | * | 9/1983 | Hanifl | 83/167 |
| 4,531,437 | A | * | 7/1985 | Szablak et al. | 83/165 |
| 4,656,907 | A | | 4/1987 | Hymmen | |

(Continued)

FOREIGN PATENT DOCUMENTS

| | | |
|---|---|---|
| DE | 202005016056 | 1/2006 |
| JP | 01146696 | 6/1989 |
| JP | 03270896 | 12/1991 |
| JP | 2007222974 | 9/2007 |

OTHER PUBLICATIONS

PCT Search Report and Written Opinion for PCT/US2007/088555, dated Aug. 18, 2009, 12 pages.

(Continued)

*Primary Examiner* — Omar Flores Sanchez
(74) *Attorney, Agent, or Firm* — Michael Best & Friedrich LLP

(57) ABSTRACT

A punch includes a base and a chip cartridge that is movably coupled to the base. The chip cartridge is movable between a first position and a second position relative to the base and defines a chamber that is configured to receive and hold chips produced during a punching operation. The chip cartridge includes a chip receiving portion that is configured to receive chips created during the punching operation and to permit entry of the chips into the chamber while the chip cartridge is in the first position. When the chip cartridge is in the second position, the chip receiving portion provides communication between the chamber and outside the chamber via an area less than or equal to about 200 percent of a surface area of the chip produced by the punch.

26 Claims, 8 Drawing Sheets

(56) References Cited

U.S. PATENT DOCUMENTS

| | | | | |
|---|---|---|---|---|
| 4,757,733 | A | 7/1988 | Barlow | |
| 4,867,309 | A * | 9/1989 | Germain | 206/366 |
| 5,178,049 | A | 1/1993 | Tsai-Hsin | |
| 5,575,188 | A * | 11/1996 | Hu | 83/167 |
| 5,632,188 | A * | 5/1997 | Karlis | 83/167 |
| 5,692,687 | A | 12/1997 | Kateley | |
| 5,778,750 | A | 7/1998 | Drzewiecki et al. | |
| 5,884,799 | A | 3/1999 | Körber et al. | |
| 6,032,566 | A | 3/2000 | Evans et al. | |
| 6,109,155 | A | 8/2000 | Huang | |
| D434,443 | S | 11/2000 | Mori et al. | |
| 6,688,199 | B2 | 2/2004 | Godston et al. | |
| D493,343 | S | 7/2004 | Chen | |
| 6,786,395 | B1 | 9/2004 | Lin | |
| 6,789,593 | B1 | 9/2004 | Aono et al. | |
| 6,799,498 | B2 | 10/2004 | Spiel | |
| 6,886,614 | B2 | 5/2005 | Ricono et al. | |
| D541,867 | S | 5/2007 | Kent et al | |
| D542,848 | S | 5/2007 | Kent et al. | |
| D564,593 | S | 3/2008 | Kent et al. | |
| 7,610,838 | B2 * | 11/2009 | Kent et al. | 83/618 |
| 2002/0020268 | A1 | 2/2002 | Mori et al. | |
| 2002/0157517 | A1 | 10/2002 | Huang | |
| 2004/0069110 | A1 | 4/2004 | Godston et al. | |
| 2004/0237748 | A1 * | 12/2004 | Potthoff et al. | 83/684 |
| 2006/0278056 | A1 | 12/2006 | Chen et al. | |
| 2007/0199424 | A1 | 8/2007 | Marks | |
| 2007/0266836 | A1 | 11/2007 | Marks | |

OTHER PUBLICATIONS

U.S. Patent Office Action dated Jul. 5, 2012 for co-pending U.S. Appl. No. 12/692,901, 11 pages.

* cited by examiner

CHIP CARTRIDGE FOR SHEET PUNCH

BACKGROUND

The present invention relates to an apparatus for performing a punching operation. More particularly, the invention relates to collecting punched paper chads or chips produced by the punching operation of a sheet punch.

Punches used to perform a punching operation, such as punching one or more holes in a stack of paper sheets, produce paper chads or chips that are often collected in a collection device or "chip tray".

SUMMARY

One common problem with known chip trays is that chips are often spilled as a user attempts to empty the chip tray into a waste receptacle. The invention provides an improved chip tray or cartridge designed to reduce or eliminate such spills.

In one embodiment, the invention provides a punch that includes a base and a chip cartridge that is movably coupled to the base. The chip cartridge is movable between a first position and a second position relative to the base and defines a chamber that is configured to receive and hold chips produced during a punching operation. The chip cartridge includes a chip receiving portion that is configured to receive chips created during the punching operation and permit entry of the chips into the chamber while the chip cartridge is in the first position. When the chip cartridge is in the second position, the chip receiving portion provides communication between the chamber and outside the chamber via an area less than or equal to about 200 percent of a surface area of the chip produced by the punch.

In another embodiment the invention provides a punch that includes a base and a chip cartridge that is movably coupled to the base to be movable between a first position and a second position relative to the base. The chip cartridge defines a chamber that is configured to receive and hold chips produced during a punching operation. The chip cartridge also includes an aperture and a movable member. When the chip cartridge is in the first position, the movable member has an open position that permits entry of chips into the chamber through the aperture during the punching operation. When the chip cartridge is in the second position the movable member is in a closed position that substantially covers the aperture and substantially inhibits chips from leaving the chamber through the aperture.

Other aspects of the invention will become apparent by consideration of the detailed description and accompanying drawings.

DETAILED DESCRIPTION

Figure 1:
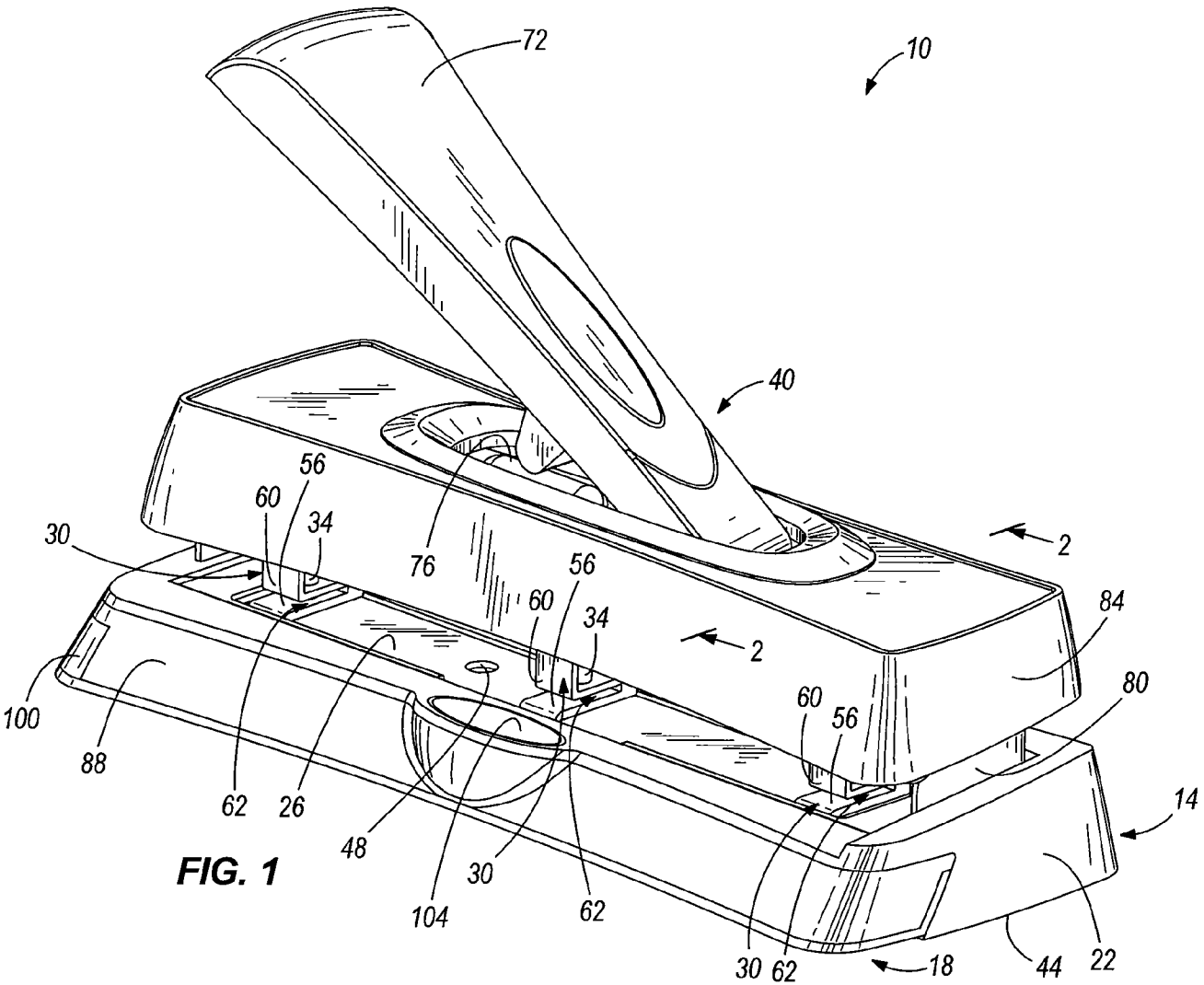
FIG. 1 is a perspective view of a paper punch shown with a chip cartridge in an engaged position.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

FIGS. 1-5 show a punch that in the illustrated embodiment is a paper punch 10 that includes a base 14 and a chip cartridge 18. The illustrated base 14 includes a support housing 22 having a sheet support surface 26. The base 14 supports punch pin housings 30, punch pins 34, and a punching mechanism 40.

The illustrated support housing 22 is designed to receive the chip cartridge 18 and substantially inhibit the chip cartridge 18 from inadvertent removal. The support housing 22 also defines a bottom surface 44 that rests on a surface such as a table or desk. In other embodiments, the support housing 22 may be shaped differently or may be configured to support the paper punch 10 for vertical sheet punching.

The illustrated sheet support surface 26 includes four punch apertures 48 (only 1 shown in FIG. 1 and only 3 shown in FIG. 4), sized to cooperate with the punch pins 34 such that paper chips 52 (FIG. 10) produced during a punching operation can pass through the sheet support surface 26 and into the chip cartridge 18. The sheet support surface 26 also at least partially supports the punch pin housings 30 such that each punch pin housing 30 is positioned on the sheet support surface 26 substantially over one of the punch apertures 48. In the illustrated embodiment, the paper punch 10 includes four punch apertures 48 and three punch pin housings 30. The punch pin housings 30, and punch pins 34 within the punch pin housings 30, may be arranged in different positions over the punch apertures 48 to accommodate different punching needs. For example, two hole punching or three hole punching with variable spacing for both may be achieved. In other embodiments, less than four or more than four punch apertures 48 are conceivable. In addition, less than three or more than three punch pin housings 30 are conceivable. For example, a two-hole punch or a one-hole punch are contemplated.

The illustrated punch pin housings 30 support the punch pins 34 between the sheet support surface 26 and the punching mechanism 40. Each punch pin housing 30 includes a paper receiving portion 56 and a pin supporting portion 60 that together define a sheet receiving opening or slot 62. Each punch pin 34 is disposed within the pin supporting portion 60 such that a top portion 64 of each punch pin 34 engages the punching mechanism 40 and a cutting portion 68 (FIG. 10) is disposed within the punch pin housing 30. While not shown, each pin supporting member 60 includes a return spring or biasing member that returns the punch pin 34 to a ready position after the punching operation is finished, as is well known by those skilled in the art. In other embodiments, the punch pin housings 30 may be shaped differently or may be configured to receive different thicknesses of stacks of paper. In addition, the illustrated punch pin housings 30 are supported by the sheet support surface 26. In other embodiments, the punch pin housings 30 may be supported by the punching mechanism 40 or another part of the paper punch 10. Furthermore, the punch pins 34 and punch apertures 48 may be different shapes (e.g. square).

The illustrated punching mechanism 40 includes a hand lever 72 and a punching member or flap 76 mounted to supports 80 of the punch 10. The hand lever 72 is mounted to the punch 10 such that it may be forced to rotate into contact with the punching member 76, causing the punching member 76 to rotate or pivot into engagement with the punch pins 34 to drive the punch pins 34. Springs or other biasing members (not shown) return the punch pins 34 and punching mechanism 40 to the ready position where the paper punch 10 may receive a stack of paper sheets into the slot 62 of the punch pin housings 30. In other embodiments, a different punching mechanism may be used as is known by those skilled in the art. For example, an automated or electric punching mechanism, or a mechanism of different linkage configuration may be used.

An optional cover 84 surrounds the punching mechanism 40 such that the hand lever 72 is visible but the majority of the punching mechanism 40 is hidden from view. The cover 84 serves multiple purposes as is known by those skilled in the art. For example, aesthetically pleasing designs or logos may be placed on the cover 84. In addition, the cover 84 substantially inhibits access to the punching mechanism 40. In other constructions the cover 84 may have a different configuration or may be removed.

The illustrated chip cartridge 18 includes a body portion 88 that defines a chamber 92, and includes a locking mechanism 96 and a chip disposal door 100. The chip cartridge 18 is movable between a first position or an engaged position (FIGS. 1 and 2), wherein the chip cartridge 18 is coupled to the support housing 22 of the base 14, and a second or disengaged position (FIGS. 4 and 5), wherein the chip cartridge 18 is not coupled to the support housing 22 of the base 14.

The illustrated locking mechanism 96 is biased upwardly by a biasing member or locking spring 98 and engages a lock recess 102 (FIG. 4) in the support housing 22 when the chip cartridge 18 is in the engaged position. A release button 104 is disposed in the support housing 22 and may be depressed by a user to compress the locking spring 98 and push the locking mechanism 96 out of the lock recess 102 (downwardly) such that the chip cartridge 18 may be removed from the punch 10 (i.e. moved to the disengaged position). While in the engaged position, the locking mechanism 96 engages the lock recess 102 and substantially inhibits movement of the chip cartridge 18 between the engaged position and the disengaged position. In other embodiments, the locking mechanism 96 may be removed or may have a different configuration.

Figure 3:
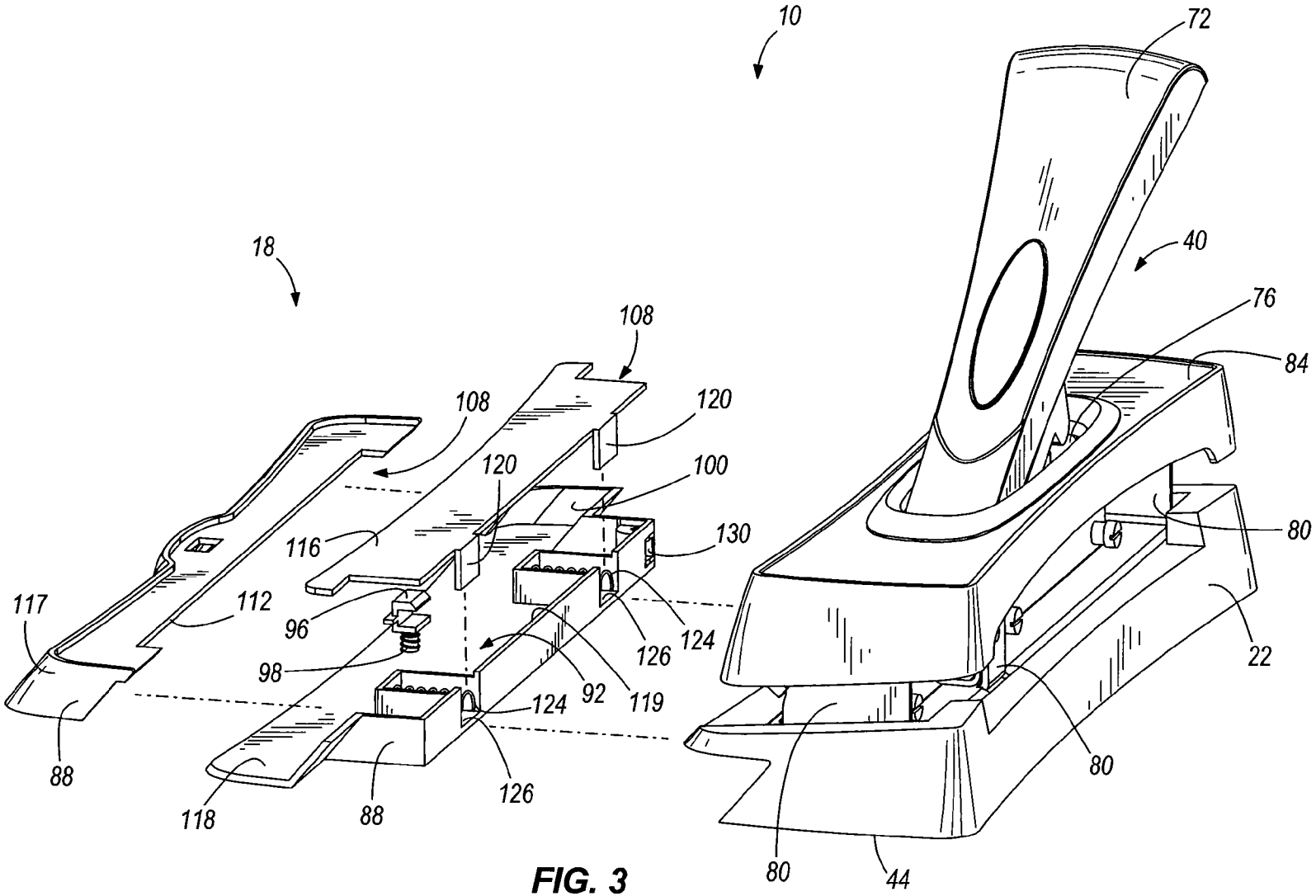
FIG. 3 is an exploded view of the chip cartridge of FIG. 1.
Figure 4:
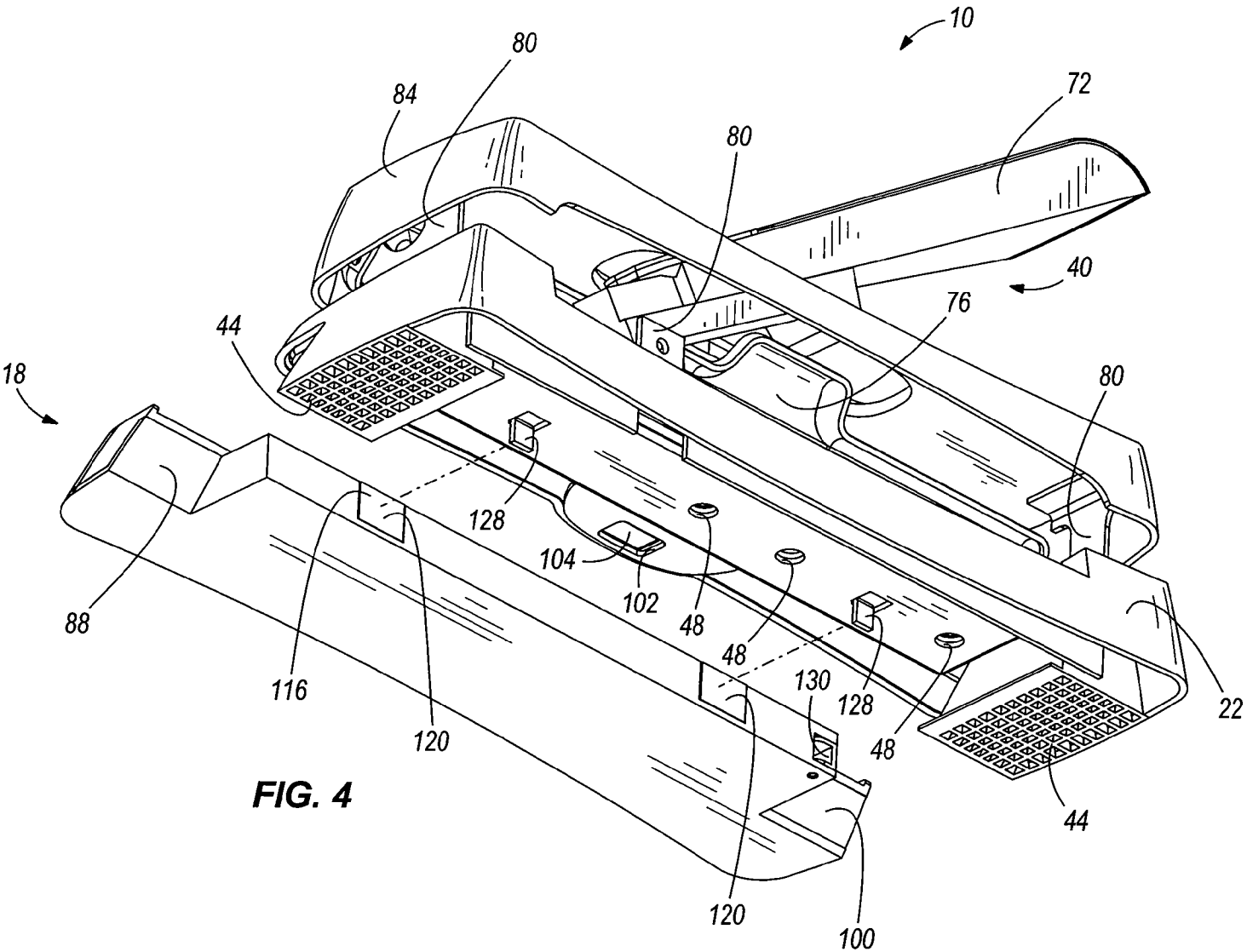
FIG. 4 is a perspective view of the bottom of the paper punch of FIG. 1.

The chip cartridge 18 further includes a chip receiving portion generally designated as 108. In the illustrated embodiment, the chip receiving portion 108 includes an aperture or single aperture 112 and a movable member that is a movable panel in the form of a slidable member 116. With reference to FIG. 3, the illustrated body portion 88 includes a first body element 117 and a second body element 118. The aperture 112 is defined by a cutout in the first body element 117 and a back wall 119 of the second body element 118. The aperture 112 is sized and positioned such that when the chip cartridge 18 is in the engaged position the punch apertures 48 are positioned above the aperture 112 and chips 52 that are punched through the punch apertures 48 fall into the chamber 92 through the aperture 112. In other embodiments, the chip receiving portion 108 may include more than one aperture 112. In addition, the body portion 88 may be formed as a single piece and the aperture 112 may be formed in the single piece body portion 88. Furthermore, the chip receiving portion 108 may include additional components or elements.

The illustrated slidable member 116 slides with respect to the aperture 112 between an open position, when the chip cartridge 18 is in the engaged position (FIGS. 1 and 2), and a closed position, when the chip cartridge 18 is in the disengaged position (FIG. 3). While in the open position the slidable member 116 uncovers the aperture 112 such that chips 52 may enter the chamber 92 through the aperture 112, and while in the closed position the slidable member 116 substantially covers the aperture 112 such that chips 52 may not enter, or more importantly exit, the chamber 92 through the aperture 112.

Figure 2:
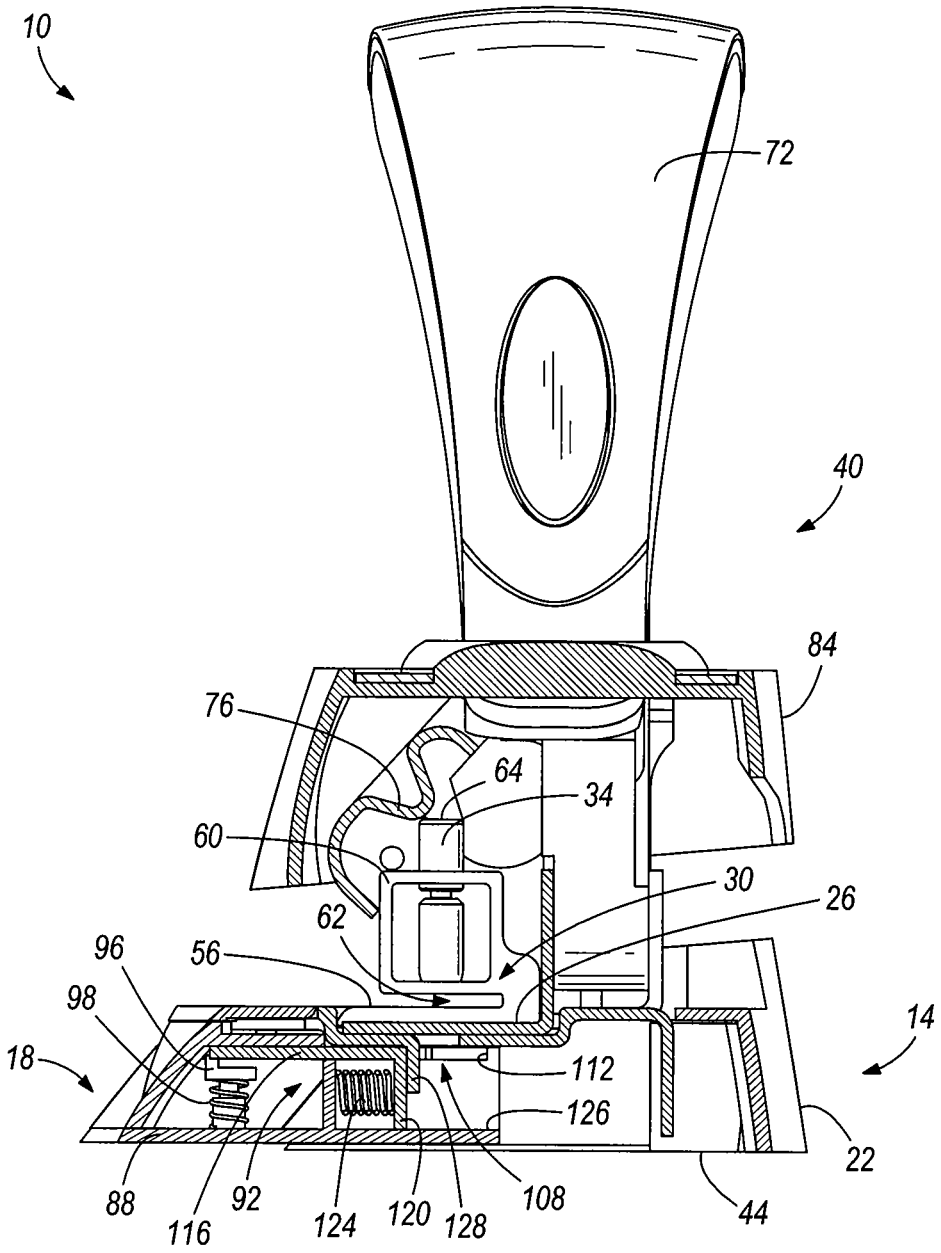
FIG. 2 is a section view of the paper punch and chip cartridge taken along line 2-2 in FIG. 1.

The illustrated slidable member 116 includes two tabs 120 that engage two biasing members such as springs 124 that are disposed within chip cartridge recesses 126 (FIG. 3) in the chip cartridge 18 and bias the slidable member 116 toward the closed position (to the right as shown in FIG. 2). The support housing 22 includes engagement members 128 (FIGS. 2 and 4) that engage the tabs 120 when the chip cartridge 18 is moved into the engaged position such that the slidable member 116 is forced into the open position (shown in FIG. 2). In other embodiments, more than two tabs 120 or less than two tabs 120 may be included. In addition, the tabs 120 may have a different shape or size. Furthermore, other biasing elements may be used to bias the movable member toward the closed position.

Figure 5:
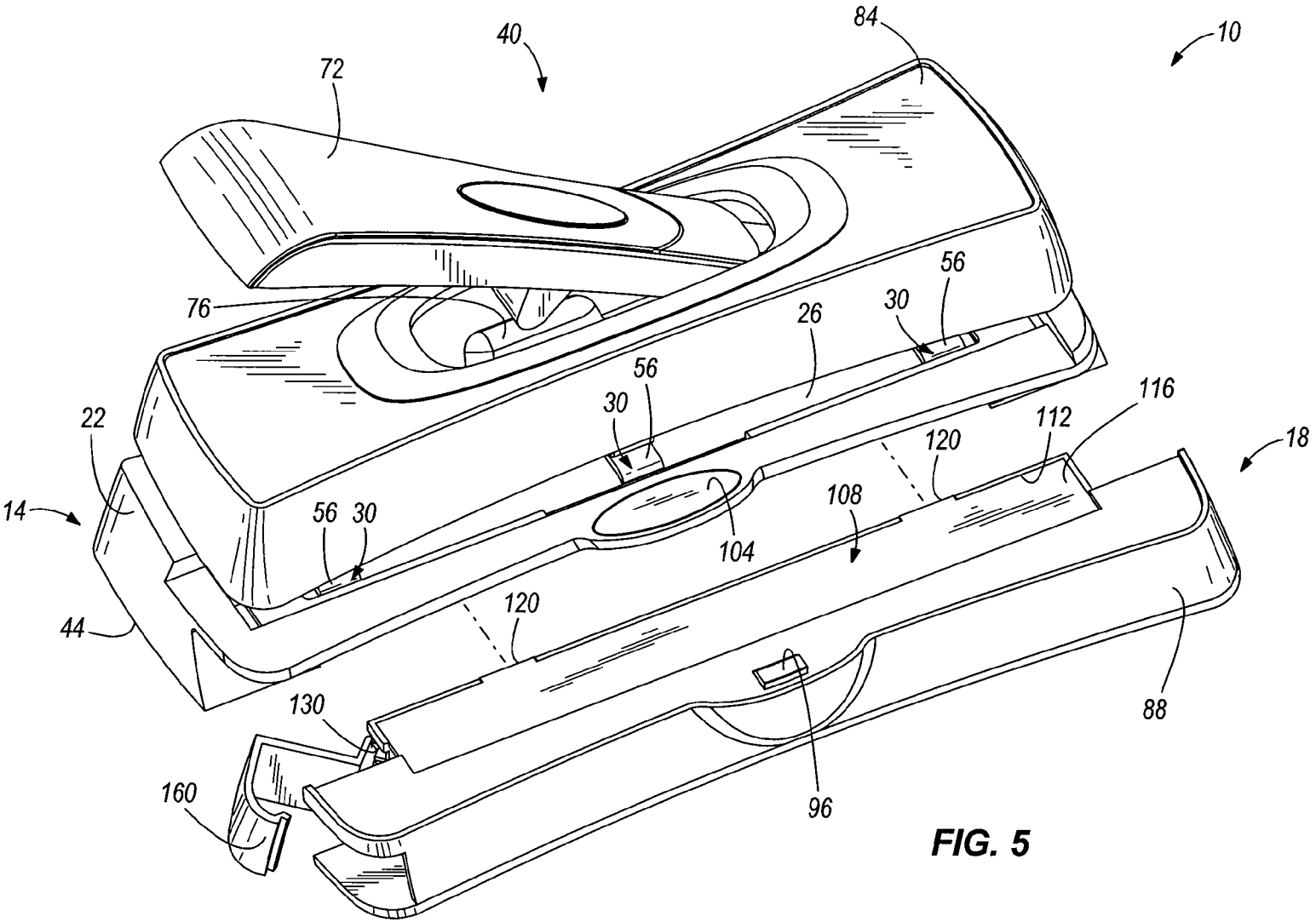
FIG. 5 is a perspective view of the paper punch of FIG. 1 shown with the chip cartridge in a disengaged position.

The illustrated chip disposal door 100 is coupled to the body portion 88 of the chip cartridge 18 with a hinge member 130 (FIGS. 3 and 4) and may be selectively opened to remove chips 52 from the chamber 92. The chip disposal door 100 is movable between an open position (as shown in FIG. 5), where the chip disposal door 100 allows chips 52 to exit the chamber 92, and a closed position (as shown in FIG. 1), where chips 52 are substantially inhibited from exiting the chamber 92. The chip disposal door 100 is designed such that while the chip cartridge 18 is in the engaged position, the chip disposal door 100 may not be moved to the open position. In the illustrated embodiment, the chip disposal door 100 is on the side of the chip cartridge 18. In other embodiments, the chip disposal door 100 may be on the front, back, top, bottom, or a combination of sides. In addition, the chip disposal door 100 may have different configurations that allow the selective removal of chips 52 from the chip cartridge 18.

In operation, the chip cartridge 18 is moved from the disengaged position where access to the chamber 92 through the aperture 112 is substantially inhibited, to the engaged position where chips 52 may enter the chamber 92 through the aperture 112. To do this, a user simply slides the chip cartridge 18 into the support housing 22 of the base 14 until the locking mechanism 96 engages the lock recess 102. As is best seen in FIG. 2, while in the engaged position, the engagement members 128 hold the slidable member 116 in the open position against the force of the springs 124 such that during a punching operation chips 52 may enter the chamber 92 through the aperture 112 of the chip receiving portion 108.

To punch a stack of sheets of paper, the user slides the stack into the slots 62 of the punch pin housings 30 and actuates the hand lever 72 such that the punch pins 34 are driven through the stack and the chips 52 are pushed through the punch apertures 48, through aperture 112 of the chip receiving portion 108, and into the chamber 92. When the user desires to empty the chip cartridge 18, the release button 104 is depressed and the chip cartridge 18 is slid out of the support housing 22 of the base 14 such that the chip cartridge 18 is removed from the punch 10. When the chip cartridge 18 is removed and in the disengaged position, the springs 124 force the slidable member 116 to the closed position such that the chips 52 are substantially inhibited from exiting the chamber 92 through the aperture 112. The user may then carry the chip cartridge 18 to a waste receptacle without fear of spilling chips 52 out of the chip cartridge 18. When the chip cartridge 18 is positioned over the waste receptacle, the user may open the chip disposal door 100 to empty the chamber 92 of chips 52. Inadvertent spilling of chips 52 during this process is reduced or eliminated.

Figure 6:
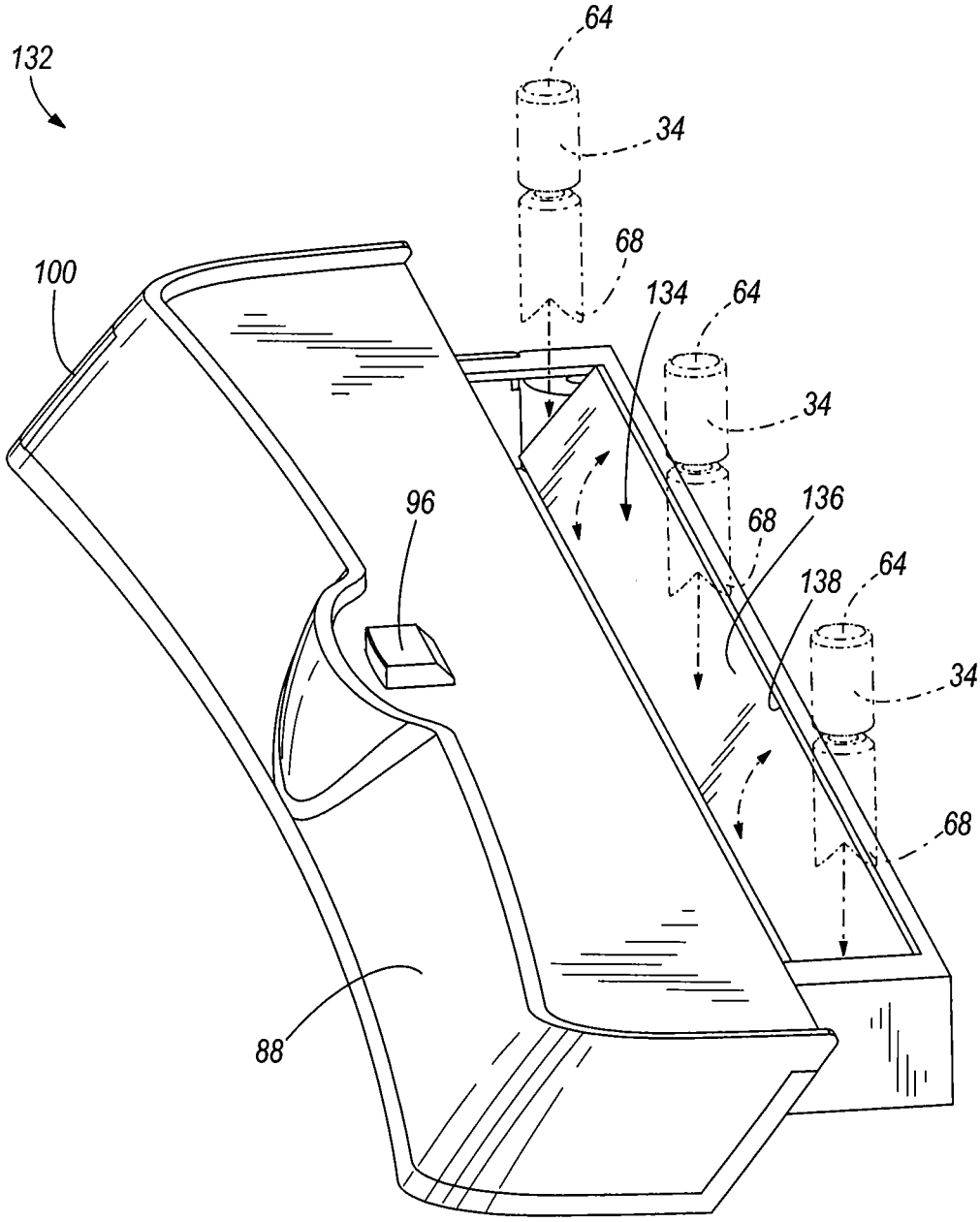
FIG. 6 is a perspective view of another embodiment of a chip cartridge.

With reference to FIG. 6, another embodiment of a chip cartridge 132 that is similar to the embodiment shown in FIGS. 1-5 is illustrated, with like parts designated by like reference numerals. The chip cartridge 132 includes a chip receiving portion 134 that includes a movable member such as a rotatable or pivoting member 136 that rotates or pivots with respect to an aperture 138 between an open position, when the chip cartridge 132 is in the engaged position, and a closed position, when the chip cartridge 132 is in the disengaged position. While in the open position the rotatable member 136 substantially uncovers the aperture 138 such that chips 52 may enter the chamber 92 through the aperture 138, and while in the closed position the rotatable member 136 substantially covers the aperture 138 such that chips 52 may not enter, or more importantly exit, the chamber 92 through the aperture 138. In other embodiments, the movable member can be more than one rotatable member 136. For example, the movable member may be two rotatable members 136.

The illustrated rotatable member 136 is biased toward the closed position by biasing members or springs such that while the chip cartridge 132 is in the disengaged position the rotatable member 136 substantially inhibits chips 52 from exiting the chamber 92 through the aperture 138. The support housing 22 of the base 14 includes engagement members (the same or different than the engagement members 128 shown in FIGS. 1-5) that engage the rotatable member 136 when the chip cartridge 132 is in the engaged position such that the rotatable member 136 is forced, against the biasing members, into the open position. In other embodiments, different engagement members may be used that are configured to move the rotatable member 136 to the open position when the chip cartridge 132 is in the engaged position. In addition, the engagement members may be the punch pins 34 or some other element of the punching mechanism 40. Furthermore, the engagement member may include an electrical system that moves the rotatable member 136 between the open position and the closed position at appropriate times.

Figure 7:
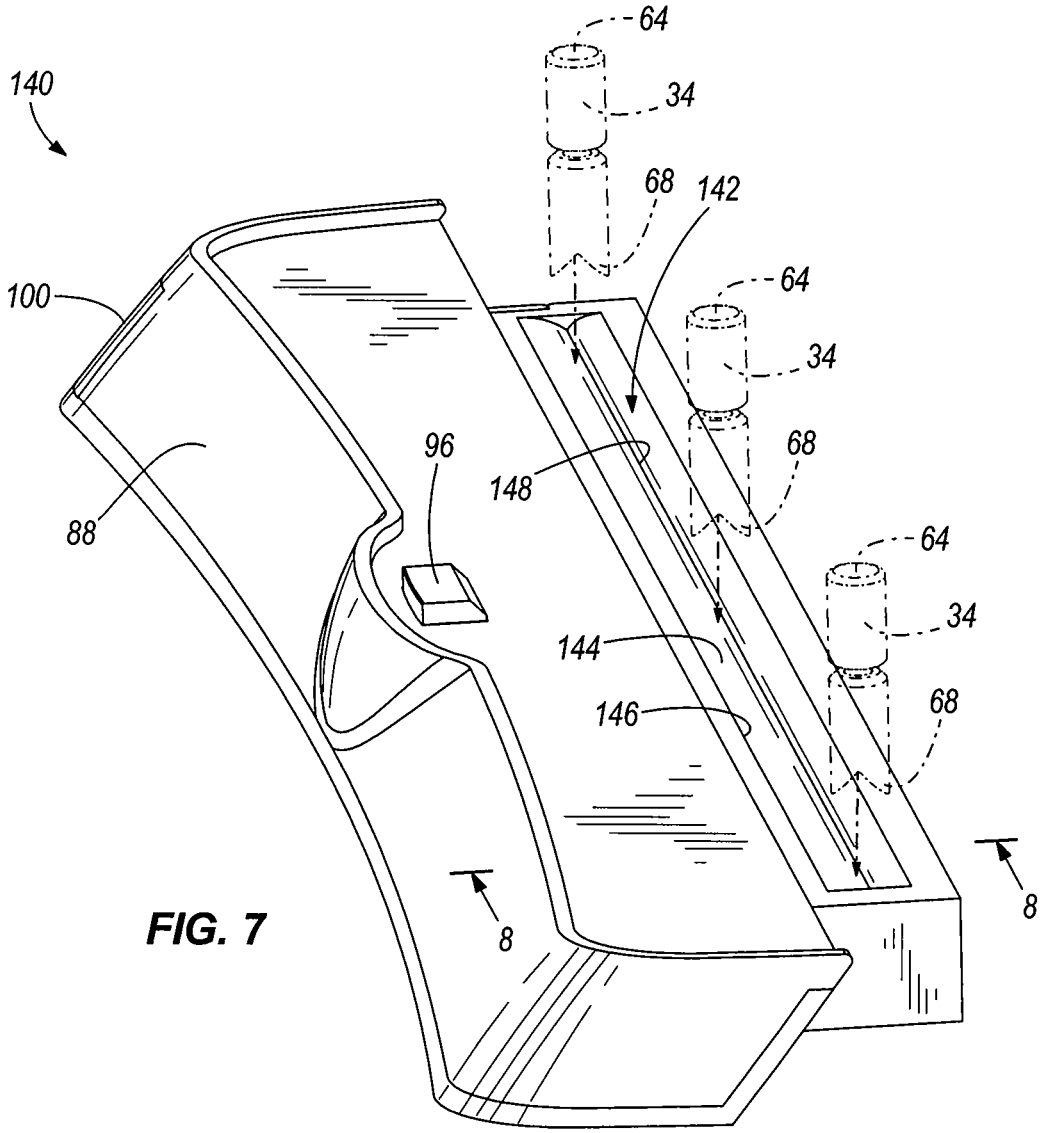
FIG. 7 is a perspective view of yet another embodiment of a chip cartridge.
Figure 8:
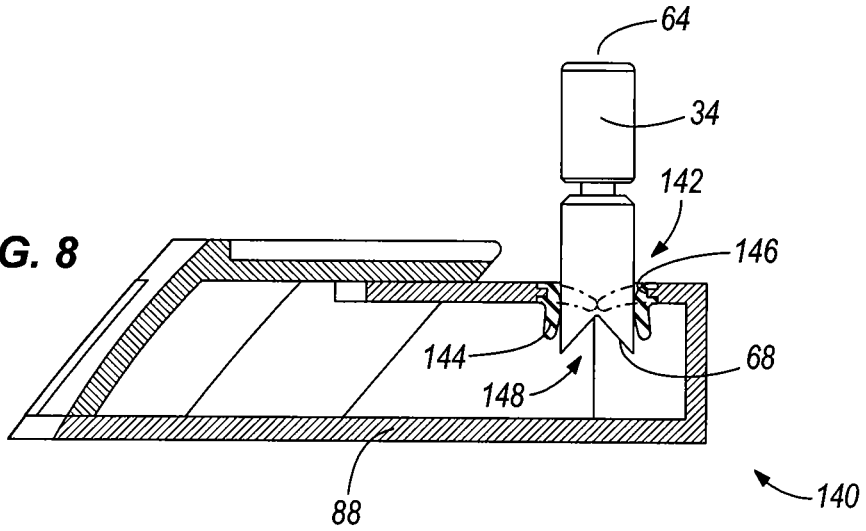
FIG. 8 is a section view taken along the line 8-8 in FIG. 7 and showing a punch pin during a punching operation.

With reference to FIGS. 7 and 8, another embodiment of a chip cartridge 140 that is similar to the embodiment shown in FIG. 6 is illustrated, with like reference numerals designating like parts. The chip cartridge 140 includes a chip receiving portion 142 that includes a movable member such as a flexible gasket 144 and an aperture 146. The flexible gasket 144 engages the aperture 146 and defines a slit 148 that allows selective access to the chamber 92 of the body portion 88. The flexible gasket 144 defines a closed position, wherein the slit 148 is substantially closed and the flexible gasket 144 substantially inhibits chips 52 from exiting the chamber 92 through the aperture 146 (shown in FIG. 7), and a open position, wherein the slit 148 is substantially open and the flexible gasket 144 allows chips 52 to enter the chamber 92 through the aperture 146 (shown in FIG. 8). The flexible gasket 144 is formed of a flexible material such that no separate biasing member is necessary to bias the flexible gasket 144 toward the closed position.

The punch 10 includes engagement members that are configured to deflect the flexible gasket 144 between the closed position and the open position. In the illustrated embodiment, the engagement members take the form of the punch pins 34 such that when the punching operation occurs, the punch pins 34 push the chips 52 into contact with the flexible gasket 144 and the continued force of the punching operation deflects the flexible gasket 144 to the open position and the chips 52 enter the chamber 92 through the aperture 146. After the punching operation, the flexible gasket 144 returns to the closed position. In other embodiments, the engagement members may have a different configuration. In addition, the engagement members may be included in the support housing 22 or another part of the punch 10.

Figure 9:
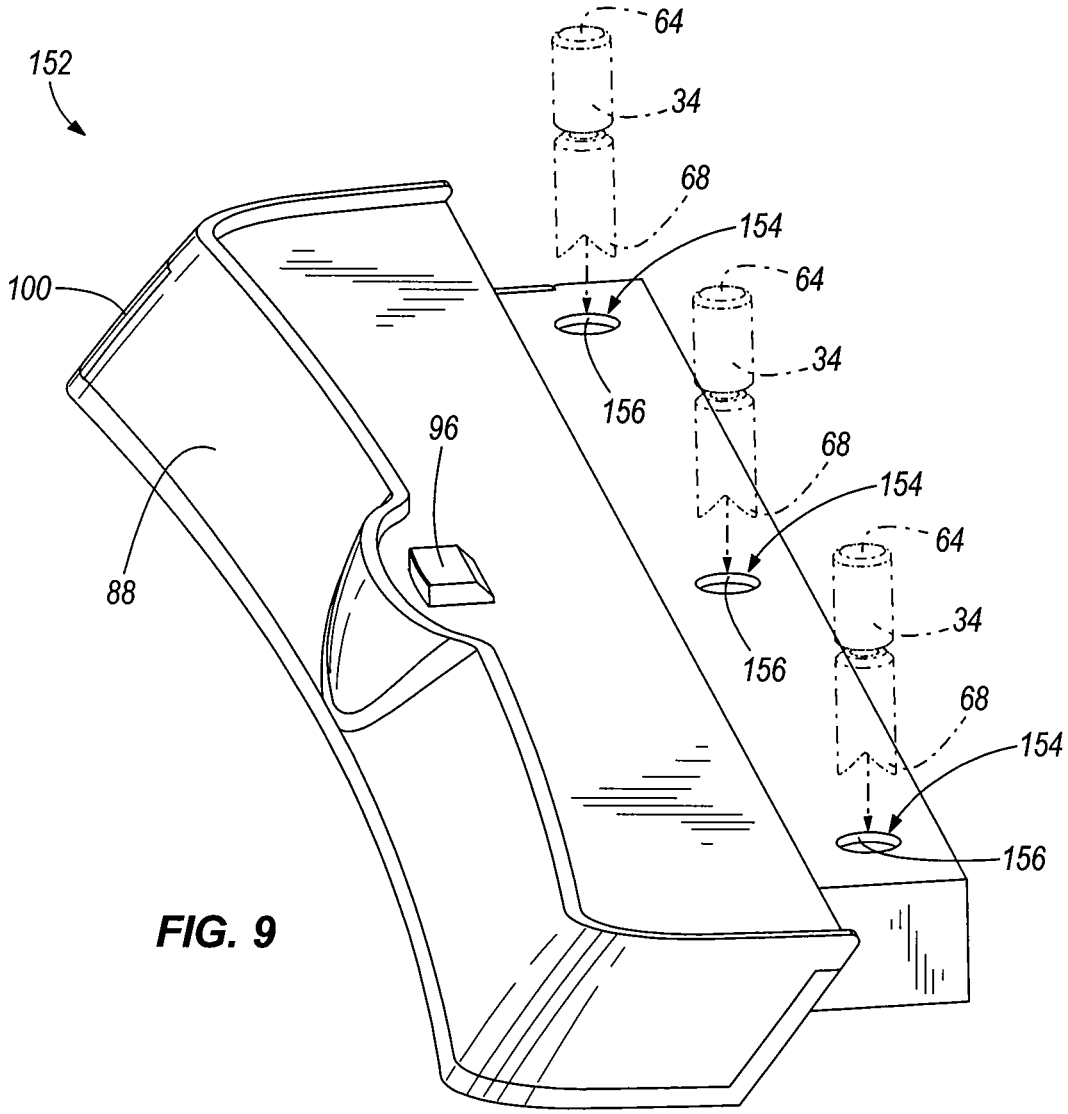
FIG. 9 is a perspective view of still another embodiment of a chip cartridge.
Figure 10:
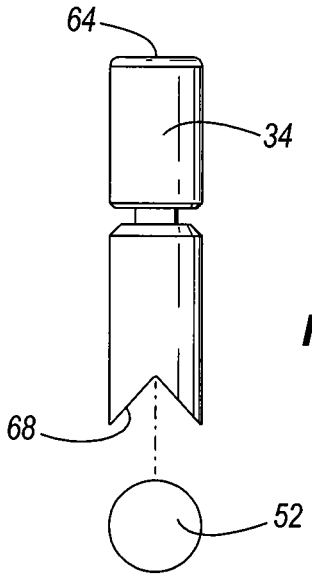
FIG. 10 is a side view of a punch pin and a chip produced by the punch pin.

With reference to FIG. 9, another embodiment of a chip cartridge 152 that is similar to the embodiment shown in FIGS. 7 and 8 is illustrated, with like parts designated by like reference numerals. The chip cartridge 152 includes three distinct chip receiving portions 154. Each chip receiving portion 154 includes an aperture 156 that aligns with one of the punch apertures 48. The chip cartridge 152 is movable between an engaged position, wherein the chip cartridge 152 may receive chips 52 into the chamber 92 through the apertures 156, and a disengaged position, wherein the chip cartridge 152 substantially inhibits the removal of chips 52 out of the chamber 92 through the apertures 156 due to the relatively small size of the apertures 156. While in the engaged position, the punching operation may punch chips 52 into the chamber 92 through the apertures 156 and when the chip cartridge 152 is removed (i.e. moved to the disengaged position), the relatively small size of the apertures 156 substantially inhibits chips 52 from exiting the chamber 92. The chip receiving portions 154, and more specifically the apertures 156 have substantially the same open area in the engaged position and the disengaged position. In the preferred embodiment, the area of each aperture 156 is approximately 100 percent to 120 percent larger than the area of the chip 52 produced by the paper punch 10. The area of the chip 52 corresponds the punch pin 34 diameter (FIG. 10). For example, a standard punch pin 34 has a diameter of about 0.25 inches. Accordingly, the chip 52 produced during the punching operation will have an area of about 0.05 square inches. As such, each aperture 156 has an open area of about 0.05 to 0.06 square inches (about 100 percent to about 120 percent of the chip area). The diameter of the corresponding aperture 156 is about 0.25 to 0.28 inches. While 120 percent of the chip 52 surface area is the preferred maximum area of the chip receiving portions 154, the spirit of the invention may be applied to chip receiving portions having an area of up to about 200 percent the surface area of the chip 52 (e.g. 140 percent, 160 percent, 180 percent, 200 percent). However, the effectiveness of containing chips 52 within the chip cartridge 152 is proportional to the surface area of the chip receiving portions 154. For example, the preferred arrangement that provides chip receiving portions with about 120 percent of the chip 52 surface area is more effective than an alternative arrangement that provides chip receiving portions with 200 percent of the chip 52 surface area. In addition, the location and number of the apertures 156 may be different to accommodate different punches 10 or different arrangements of punch pin housings 30 (i.e. a one-hole punch or a two-hole punch).

In the embodiments described above and in other embodiments not described, the chip cartridge 18, 132, 140, 152 is removably coupled to the base 14 of the punch 10 and provides a chip receiving portion 108, 134, 142, 154 that while removed from the punch 10 provides an area less than or equal to about 200 percent of the surface area of the chip 52 produced by the punch 10. In addition, other embodiments may configure the chip cartridge 18, 132, 140, 152 to not completely de-couple from the punch 10 when moved to the disengaged position. For example, the chip cartridge 18, 132, 140, 152 may be rotatable into the disengaged position without completely disconnecting from the base, or may have a cord that couples the chip cartridge 18, 132, 140, 152 to the punch in both the engaged and disengaged positions.

The embodiment shown in FIGS. 1-5 illustrates the chip receiving portion 108 that substantially closes when the chip cartridge 18 is removed from the punch (i.e. moved to the second position) such that the area of the chip receiving portion 108 is about zero percent of the surface area of the chip 52 and clearly less than 200 percent of the surface area of the chip 52.

The embodiment shown in FIG. 6 illustrates the chip receiving portion 134 that substantially closes when the chip cartridge 132 is removed from the punch (i.e. moved to the second position) such that the area of the chip receiving portion 108 is about zero percent of the surface area of the chip 52 and clearly less than 200 percent of the surface area of the chip 52.

The embodiment shown in FIGS. 7 and 8 illustrates the chip receiving portion 142 that is substantially closed at all times that a punching operation is not occurring. As such, when the chip cartridge 140 is removed from the punch 10 (i.e. moved to the second position) the area of the chip receiving portion 142 is about zero percent of the surface area of the chip 52 and clearly less than 200 percent of the surface area of the chip 52. When the chip cartridge 140 is in the engaged or first position, the flexible gasket 144 is moved to the open position during a punching operation.

The embodiment shown in FIG. 9 illustrates three chip receiving portions 154 that have substantially the same area when the chip cartridge 152 is in the first position and the second position. Each of the illustrated chip receiving portions 154 has an area at all times that is less than about 200 percent of the surface area of the chip 52.

In addition, the chip cartridge 18, 132, 140, 152 may have more than one chip receiving portion 108, 134, 142, 154. Accordingly, some embodiments may include more than one aperture and/or more than one movable member that work together to selectively allow access to the chamber 92 of the chip cartridge 18, 132, 140, 152.

Although, various configurations of engagement members were described with respect to the above embodiments, one skilled in the art will understand that many alternatives exist to actuate the chip receiving portion 108, 134, 142, 154 to an open position. For example, an electronic system may be used to move the movable member to the open position while the chip cartridge 18, 132, 140, 152 is in the engaged or first position. Alternatively, an electronic system may open the chip receiving portion 108, 134, 142, 154 during a punching operation.

As will be understood by one skilled in the art, the invention is applicable to a wide variety of punch designs and styles. As such, the style of punch or the punched material should not limit the invention.

Various features and advantages of the invention are set forth in the following claims.

What is claimed is:

1. A punch comprising:

a base; and a chip cartridge movably coupled to the base and movable between a first position and a second position relative to the base, the chip cartridge defining a chamber configured to receive and hold chips produced during a punching operation, the chip cartridge including a chip receiving portion having an aperture configured to receive chips created during the punching operation and permit entry of the chips into the chamber while the chip cartridge is in the first position, and when the chip cartridge is in the second position, the chip receiving portion provides communication between the chamber and outside the chamber via an area less than or equal to about 200 percent of a surface area of the chip produced by the punch;

wherein the chip receiving portion includes a movable member configured to move to a closed position to substantially cover the aperture and inhibit chips from leaving the chamber through the aperture, the movable member being biased toward the closed position by a biasing element mounted on the chip cartridge.

2. The punch of claim 1, wherein the movable member is a movable panel.

3. The punch of claim 2, wherein the movable panel is biased by a spring.

4. The punch of claim 2, wherein when the chip cartridge is in the first position, the movable panel is moved to an open position wherein chips may enter the chamber through the aperture.

5. The punch of claim 2, wherein the movable panel slides relative to the aperture.

6. The punch of claim 2, wherein the movable panel pivots relative to the aperture.

7. The punch of claim 1, wherein the chip cartridge further includes a chip disposal door configured to selectively allow and inhibit removal of chips from the chamber.

8. The punch of claim 1, wherein the chip receiving portion provides communication between the chamber and outside the chamber via an area less than or equal to about 120 percent of a surface area of the chip produced by the punch while the chip cartridge is in the second position.

9. The punch of claim 1, wherein the biasing element is positioned below the movable member when the chip cartridge is in the first position.

10. The punch of claim 1, wherein the biasing element is positioned within the chip cartridge.

11. The punch of claim 1, wherein the biasing element is mounted within a recess of the chip cartridge.

12. The punch of claim 4, wherein the biasing element is operable to repeatedly bias the movable panel from the open position to the closed position.

13. A punch comprising:

a base; and a chip cartridge movably coupled to the base and movable between a first position and a second position relative to the base, the chip cartridge defining a chamber configured to receive and hold chips produced during a punching operation, the chip cartridge having an aperture and a movable member;

wherein, when the chip cartridge is in the first position, the movable member has an open position permitting entry of chips into the chamber through the aperture during the punching operation;

wherein, when the chip cartridge is in the second position, the movable member is biased by a biasing element mounted on the chip cartridge into a closed position substantially covering the aperture and substantially inhibiting chips from leaving the chamber through the aperture; and wherein the biasing element is mounted within a recess of the chip cartridge.

14. The punch of claim 13, wherein when the chip cartridge is in the first position, the movable member is automatically moved to the open position.

15. The punch of claim 13, wherein the recess does not communicate with the chamber.

16. The punch of claim 13, wherein the movable member is a movable panel.

17. The punch of claim 16, wherein the movable panel is biased by a spring.

18. The punch of claim 16, wherein the movable panel slides relative to the aperture.

19. The punch of claim 16, wherein the movable panel pivots relative to the aperture.

20. The punch of claim 13, wherein the chip cartridge further includes a chip disposal door configured to selectively allow and inhibit removal of chips from the chamber.

21. The punch of claim 13, wherein the punch includes an engagement member operable to move the movable member to the open position when the chip cartridge is in the first position.

22. The punch of claim 13, wherein the chip cartridge further includes a locking mechanism operable to secure the cartridge in the first position relative to the base.

23. The punch of claim 13, wherein the chip cartridge is coupled to the base when in the first position, and is not coupled to the base when in the second position.

24. The punch of claim 13, wherein the biasing element is positioned below the movable member when the chip cartridge is in the first position.

25. The punch of claim 13, wherein the biasing element is positioned within the chip cartridge.

26. The punch of claim 13, wherein the biasing element is operable to repeatedly bias the movable member from the open position to the closed position.

* * * * *